United States Patent [19]

Hass et al.

[11] 4,053,059

[45] Oct. 11, 1977

[54] PORTABLE OVERHEAD CRANE AND METHOD OF INSTALLING IT

[75] Inventors: Winfield M. Hass; Howard E. Niehaus; James L. Pack, all of Owensboro, Ky.

[73] Assignees: Southwire Company, Carrollton, Ga.; National Steel Corporation, Pittsburgh, Pa.

[21] Appl. No.: 660,755

[22] Filed: Feb. 23, 1976

Related U.S. Application Data

[62] Division of Ser. No. 559,484, March 18, 1975, Pat. No. 3,973,679.

[51] Int. Cl.[2] ..... B66C 17/06; B66C 19/02

[52] U.S. Cl. ..... 212/18; 105/163 R; 212/125

[58] Field of Search ..... 212/10, 18, 71, 98, 212/125-129, 1, 13, 19; 104/98, 122; 105/163 R, 163 SK; 187/9 R; 294/85

[56] References Cited

U.S. PATENT DOCUMENTS

| | | | |
|---|---|---|---|
| 1,070,545 | 8/1913 | Sheridan | 105/163 R |
| 2,643,740 | 6/1953 | Quayle | 187/9 R |
| 3,389,809 | 6/1968 | Wilson | 212/18 X |
| 3,777,853 | 12/1973 | Miller | 187/9 R |

FOREIGN PATENT DOCUMENTS

| | | | |
|---|---|---|---|
| 542,103 | 10/1955 | Belgium | 105/163 R |
| 313,773 | 9/1971 | U.S.S.R. | 212/13 |

*Primary Examiner*—Robert J. Spar
*Assistant Examiner*—Carl Rowold
*Attorney, Agent, or Firm*—Van C. Wilks; Herbert M. Hanegan; Stanley L. Tate

[57] ABSTRACT

This disclosure relates to a method of and apparatus for lifting a load utilizing an existing bridge or gantry-type overhead crane in combination with a portable lifting beam or Strongback adapted to be lifted into position and partially supported by the existing bridge crane. The portable lifting beam includes a horizontally extending main beam having a telescoping section to reduce the longitudinal extent of the main beam to a dimension less than the distance between the parallel rails upon which the bridge crane is supported, whereby the lifting beam may be raised and lowered by the bridge crane between the parallel rails while being disposed perpendicular thereto. Once the lifting beam is lifted above the parallel rails, the hydraulic means are actuated to extend the telescoping section from its retracted position to increase the longitudinal extent of the main beam to a dimension equivalent to the distance between the parallel rails whereby the portable lifting beam or Strongback may be disposed thereon. The bridge crane and the Strongback are operable in tandem to lift a load, and include load cell means for correlating the operation of the respective lifting means to the bridge crane and Strongback whereby a load may be apportioned therebetween.

9 Claims, 9 Drawing Figures

PORTABLE OVERHEAD CRANE AND METHOD OF INSTALLING IT

This is a division of application Ser. No. 559,484, filed Mar. 18, 1975, now U.S. Pat. No. 3,973,679.

BACKGROUND OF THE INVENTION

This invention relates generally to the material handling art, and more particularly to a method of and apparatus for lifting a load utilizing an existing bridge or gantry-type crane in combination with a portable lifting beam or Strongback adapted to be lifted into operable position and partially supported by the bridge crane.

This invention finds particular usefulness in aluminum reduction plants for lifting and transporting spent pot shells used in the electrolytic production of aluminum. In the commercial production of aluminum which is carried out by the Hall-Heroult process, aluminum oxide, refined from bauxite ores, is reduced electrolytically in an aluminum reduction cell, usually referred to as a pot. The pot includes an upper assembly through which one or more carbon anodes extend downwardly into the interior thereof, and a carbon-lined steel lower shell which contains the molten metal and which serves as the cathode of the cell. In the process, alumina, the solute is dissolved in molten cryolite, the solvent, at a temperature of approximately 970° C. The dissolved alumina, when subjected to an external current source, disassociates into positive aluminum and negative oxygen ions. As aluminum is produced, it is periodically syphoned off from the pot.

A typical aluminum reduction plant includes several hundred pots divided into a plurality of potlines, each of which might have approximately 100 pots connected in series. Each potline is enclosed in a room or bay extending several hundred feet in length. Each potline is provided with a bridge or gantry-type crane for servicing the various pots contained therein.

During operation the cathodic lining of the lower shell absorbs bath material causing it to expand and distort the shell, and almost doubling its weight. The lining normally deteriorates gradually and has a useful life of from 1 to 5 years (1200 days average). When the shell becomes "spent," the old carbon lining must be removed and the shell then relined with new material. However, because of the aforementioned buildup of weight in a spent shell, the shell will be too heavy to be lifted by the existing bridge or gantry crane. Consequently, in prior art systems the shell would have to be relined in place and the pot station would have to be out of service for the length of time required to demolish and remove the old carbon cathode lining, thereafter remove the shell from the line and replace it with a spare shell, and then reline the new shell in place. During this time, of course, the pot station was out of operation, and plant capacity was reduced accordingly. In a plant containing several hundred pots, there would normally be at least two or three pots down at any given time. Moreover, maintenance of a pot in line involved risk to personnel working under the existing hazardous conditions.

Of course, if the overhead bridge or gantry crane had the capacity to lift a spent shell prior to removal of the bath-absorbed carbon lining therefrom, this downtime and risk could be substantially reduced. However, because large aluminum reduction plants include several potlines or bays, each serviced by a separate bridge crane, it would involve considerable capital expenditure to upgrade each of these bridge cranes to the point where they would have the capacity to lift a spent pot shell which could weigh approximately 95 tons. Moreover, the full capacity of such an upgraded crane would be utilized only a small fraction of the time, and the normal daily operations, such as carrying tapping crucibles and other equipment, would be uneconomically and cumbersomely performed by a crane having a much greater capacity than necessary.

SUMMARY OF THE INVENTION

In view of the foregoing, it should be apparent that there is a need in the art for a crane system, particularly useful in aluminum reduction plants, having the capacity to lift heavy spent shells encrusted with bath-absorbed carbon linings, without the necessity for upgrading each of the existing bridge cranes to the point where normal daily operations would have to be performed by a crane having a much greater capacity than normally necessary. It is, therefore, a primary object of this invention to improve the operating efficiency and production of aluminum reduction plants.

More particularly, it is an object of this invention to reduce the downtime of a pot station during removal and replacement of a spent shell.

Another object of this invention is to provide a crane system for replacing a spent shell without first demolishing and removing the bath-absorbed carbon lining therefrom.

A further object of this invention is to operate an aluminum reduction plant having several potlines, each serviced by a separate overhead bridge crane of normal capacity for carrying out routine plant functions, and to provide a system for upgrading the lifting capacity of each of the bridge cranes when necessary to lift a spent shell out of the potline and transport it to a maintenance station, and to transport a relined cell back into the potlines.

These and other objects of the invention, as will become hereinafter apparent, are accomplished in accordance with this invention by providing a portable lifting beam or Strongback that can be transported on a special ground vehicle to any potline or bay in an aluminum reduction plant. The Strongback is adapted to be lifted by the existing bridge crane of the potline and used in conjunction therewith to lift a spent shell encrusted with a bath-absorbed carbon lining. The combined load carrying capacity of the bridge crane and the Strongback together is sufficient to carry and transport the spent shell without the necessity of first removing the old lining therefrom.

The method of lifting a load using a bridge crane and the portable lifting beam in tandem comprises the steps of:

a. positioning the bridge crane on a pair of overhead rails;

b. positioning the portable lifting beam on the same pair of rails in juxtaposed relation to the bridge crane;

c. operatively connecting the lifting mechanism of the bridge crane to the portable lifting beam whereupon the portable lifting beam will be supported both by the rails and the bridge crane;

d. connecting the lifting mechanism of the portable lifting beam to the load; and e. correlating the operation of the respective lifting mechanisms of the bridge crane and portable lifting beam whereby the load will be apportioned therebetween.

Further in accordance with the invention, the aforementioned step of correlating the operation of the respective lifting mechanisms includes activating the lifting mechanism of the bridge crane until the bridge crane is carrying a predetermined first portion of the load, and then deactivating the lifting mechanism of the bridge crane and activating the lifting mechanism of the portable lifting beam to carry the remainder of the load and thereby lift the same.

In view of the foregoing, is should be apparent that there is also need in the art for a portable lifting beam or Strongback that is capable of operating in the aforementioned system to perform the described functions. It is thus a further object of this invention to provide a novel portable lifting beam adapted to be transported to a worksite and lifted by an existing overhead bridge crane to an operative position spanning two parallel rails, the portable lifting beam including a horizontally extending main beam having wheels mounted on the ends thereof for rollingly supporting the portable lifting beam on the rails, the main beam including a telescoping section, and a hydraulic assembly for retracting the telescoping section to reduce the longitudinal extent of the main beam to a dimension less than the distance between the parallel rails whereby the portable lifting beam may be raised and lowered between the rails while being disposed perpendicular thereto.

A further object of this invention is to provide a portable lifting beam as described above wherein the hydraulic mechanism is adapted to extend the telescoping section of the main beam from its retracted position to increase the longitudinal extent of the main beam to a dimension equivalent to the distance between the parallel rails whereby the wheels may be positioned thereon.

The novel portable lifting beam constructed in accordance with this invention includes the aforementioned hydraulic mechanism mounted internally of the telescoping section and extending longitudinally thereof, the telescoping section including inner and outer relatively movable concentric housings, and wherein the hydraulic mechanism includes a cylinder mounted within the inner housing and having an operating arm rigidly connected to the outer housing whereby actuation of the hydraulic mechanism will cause the operating arm to move the outer housing with respect to the inner housing thereby effecting either retraction or extension of the telescoping section.

The portable lifting beam includes a hydraulic lifting mechanism carried by the main beam and including at least one vertically disposed cylinder and piston arrangement. An operating rod extends from the piston and supports an idler sprocket support thereon. At least one idler sprocket wheel is rotatably mounted in the support frame and a hoisting chain is disposed over the at least one sprocket wheel. One end of the chain is connected to the main beam and the other end carries a load-engaging hook adapted to be connected to the spent shell. A source of hydraulic fluid is provided to be selectively supplied to the hydraulic lifting mechanism whereby raising or lowering of the operating rod will cause translation and rotation of the at least one idler sprocket wheel and corresponding movement of the chain to move the shell or other load in the corresponding direction.

It is yet another object of this invention to provide a method of operatively positioning the above-described extensible portable lifting beam in overhead relation to a load for tandem operation in conjunction with an existing bridge crane, comprising the steps of:

a. disposing the portable lifting beam beneath the overhead bridge crane which is carried by overhead parallel rails with the portable lifting beam aligned transverse to the rails and longitudinally extending a distance less than the distance between the rails:

b. lifting the portable lifting beam with the bridge crane to a position above the rails;

c. extending the portable lifting beam longitudinally to position the extremities thereof over the rails;

d. lowering the portable lifting beam onto the rails such that it is supported both by the rails and by the bridge crane; and e. moving both the bridge crane and the portable lifting beam as a unit along the rails to a position above a load.

With the above and other objects in view that may become hereinafter apparent, the nature of the invention may be more clearly understood by reference to the several views illustrated in the attached drawings, the following detailed description thereof, and the appended claimed subject matter:

IN THE DRAWINGS

FIG. 1 is a perspective view of the portable lifting beam of this invention suspended over parallel rails of an existing bridge crane, the bridge crane being shown in phantom above the portable lifting beam with its hoist cables connected to the main beam of the portable lifting beam;

FIGS. 2*a* and 2*b* are vertical sectional views taken along line 2—2 of FIG. 1, and illustrate the right-hand and left-hand sides of the portable lifting beam, respectively, the telescoping section of the main beam and its hydraulic actuating mechanism being illustrated in FIG. 2*a;*

Figure 5:
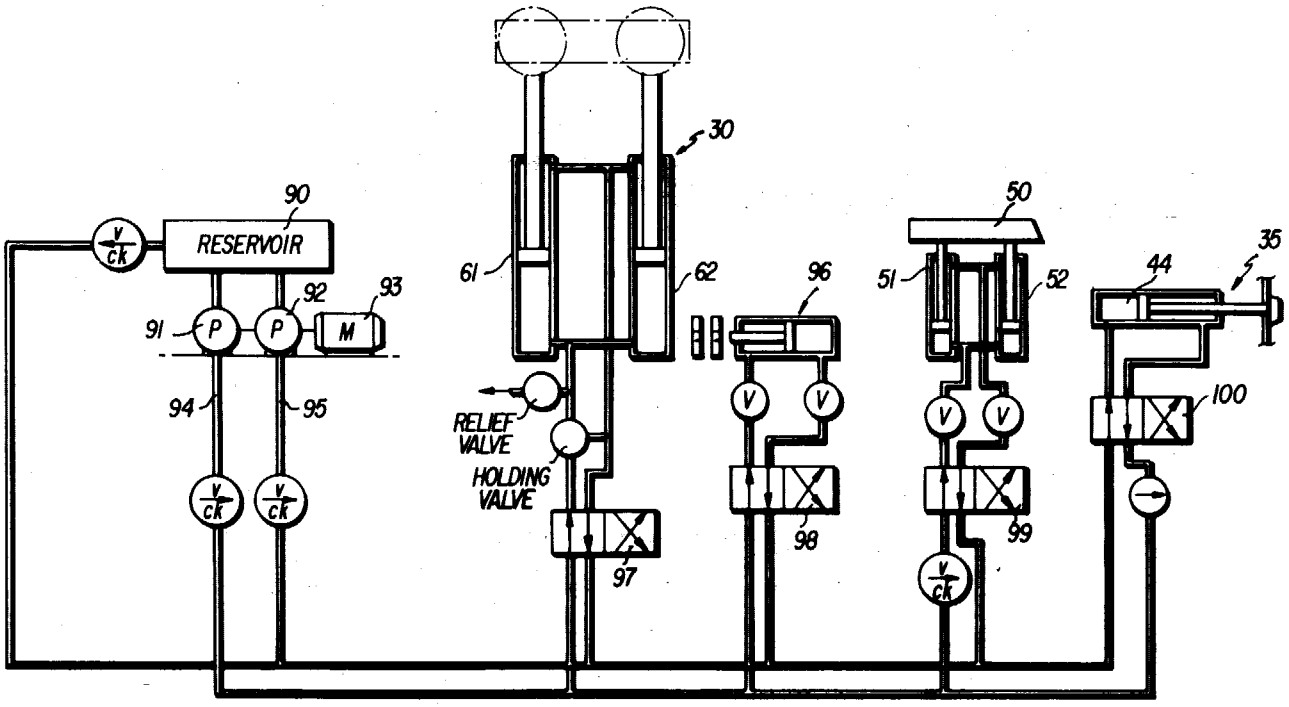
Figure 6A:
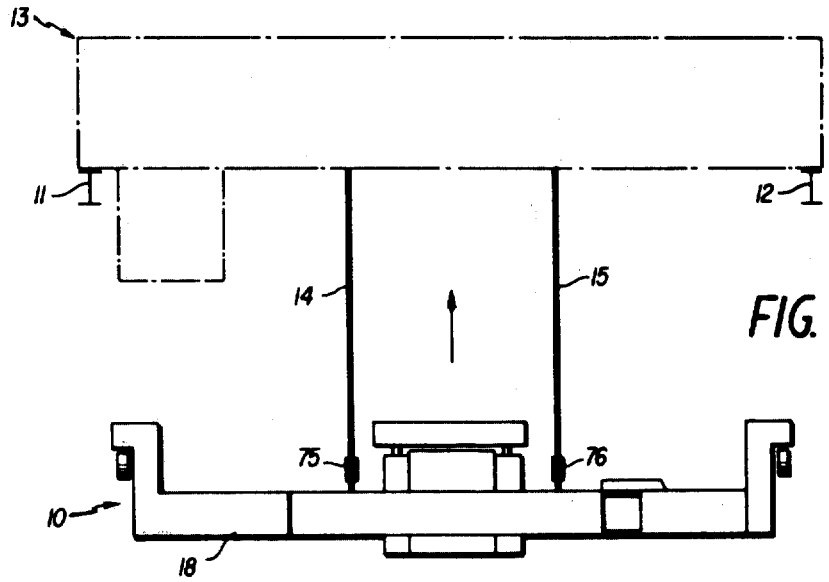
Figure 6B:
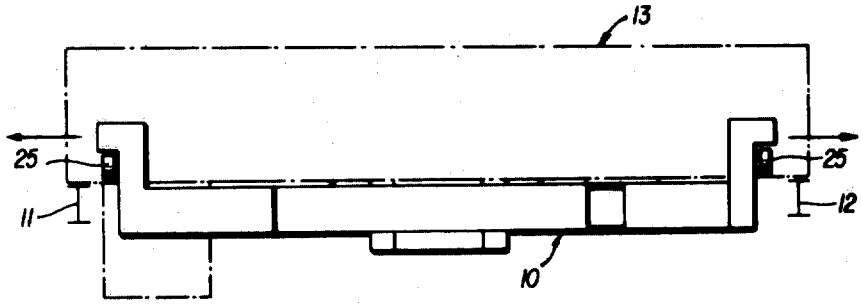
Figure 6C:
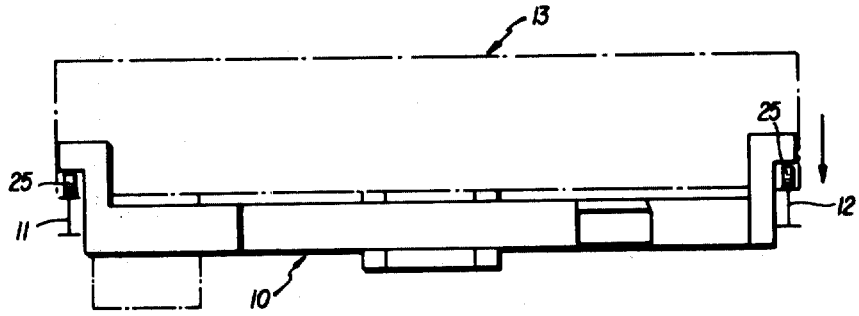

FIG. 5 is a diagrammatic view of the hydraulic system of the lifting beam; and FIGS. 6*a*, 6*b* and 6*c* are schematic views of the tandem crane system, and illustrate the steps in lifting the portable lifting beam to a position above the rails of the bridge crane, extending the main beam of the portable lifting beam so that the wheels thereof are positioned immediately over the respective side rails, and setting the portable lifting beam down on the rails.

DETAILED DESCRIPTION OF THE PREFERRED EMBODIMENT

Figure 1:
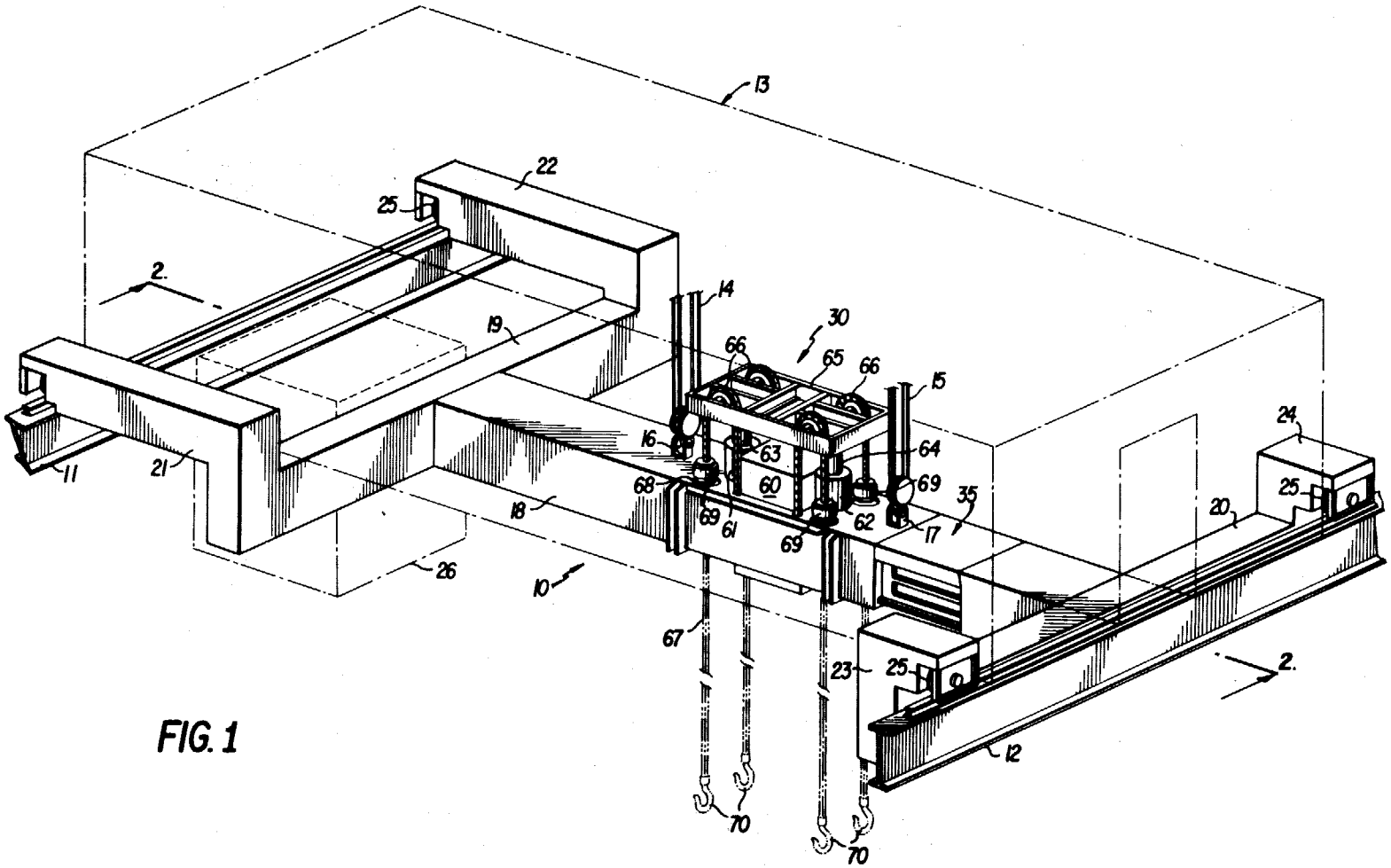

Referring now to the drawings in detail, there is illustrated in FIG. 1 the portable lifting beam or strongback of this invention designated generally by the numeral 10. The lifting beam 10 is shown disposed upon parallel rails 11, 12 for an existing bridge crane 13 illustrated in phantom in juxtaposed relation to the portable lifting beam 10. The bridge crane 13 includes an overhead carriage (not shown) from which hoist cables 14, 15 extend downwardly and which include load-supporting devices or hooks 16, 17, respectively, adapted to be coupled to the portable lifting beam 10.

The portable lifting beam 10 includes a horizontally extending main beam 18, transversely extending secondary beams 19, 20 at each end of the main beam 18, terminal beams 21, 22 and 23, 24 extending from each of the secondary beams 19 and 20, respectively, and drive wheels 25 mounted in each of the terminal beams 21, 23 rollingly engaging the side rails 11, 12. The secondary beam 19 is spaced outwardly from the adjacent side rail 11 a distance sufficient to permit an operator's cab 26 of the bridge crane 13 to extend downwardly therebetween. The portable lifting beam 18 further includes a hoisting or lifting assembly 30 and a telescoping section 35, each of which will be discussed in more detail hereinafter.

Figure 2A:
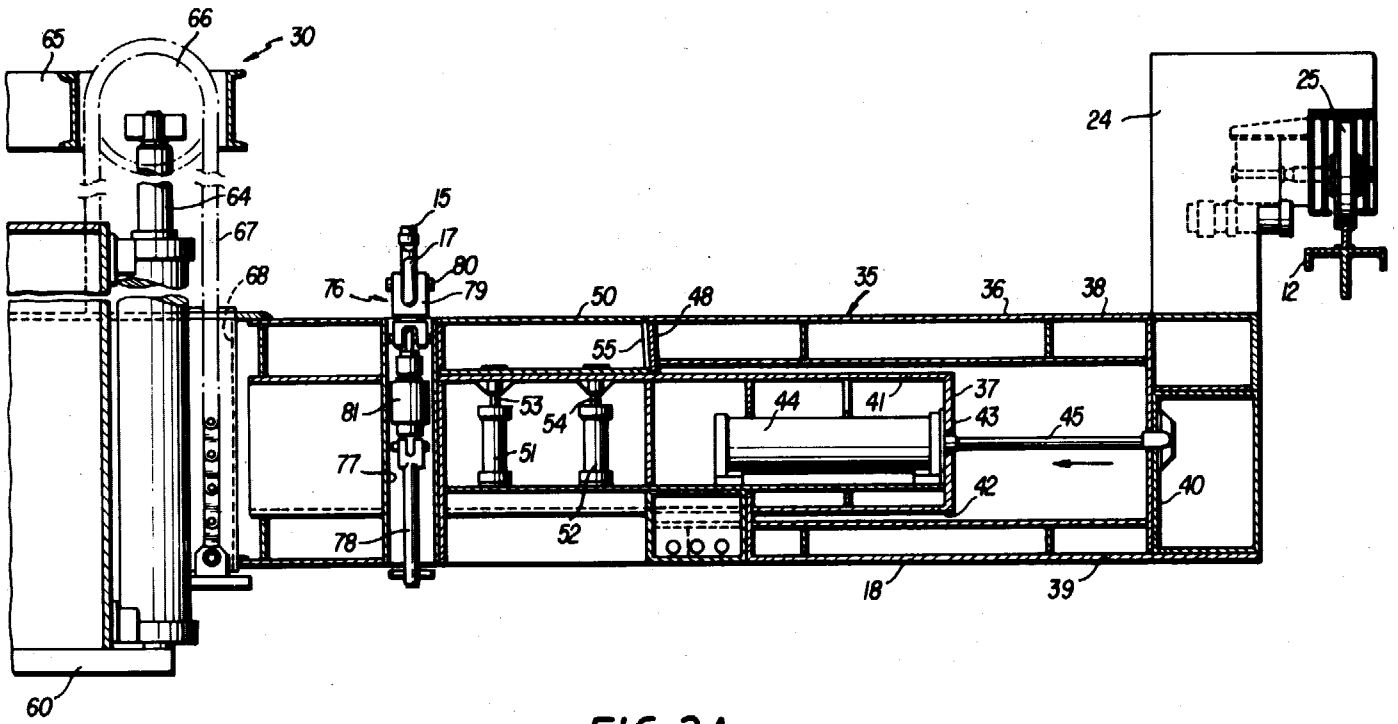
Figure 3:
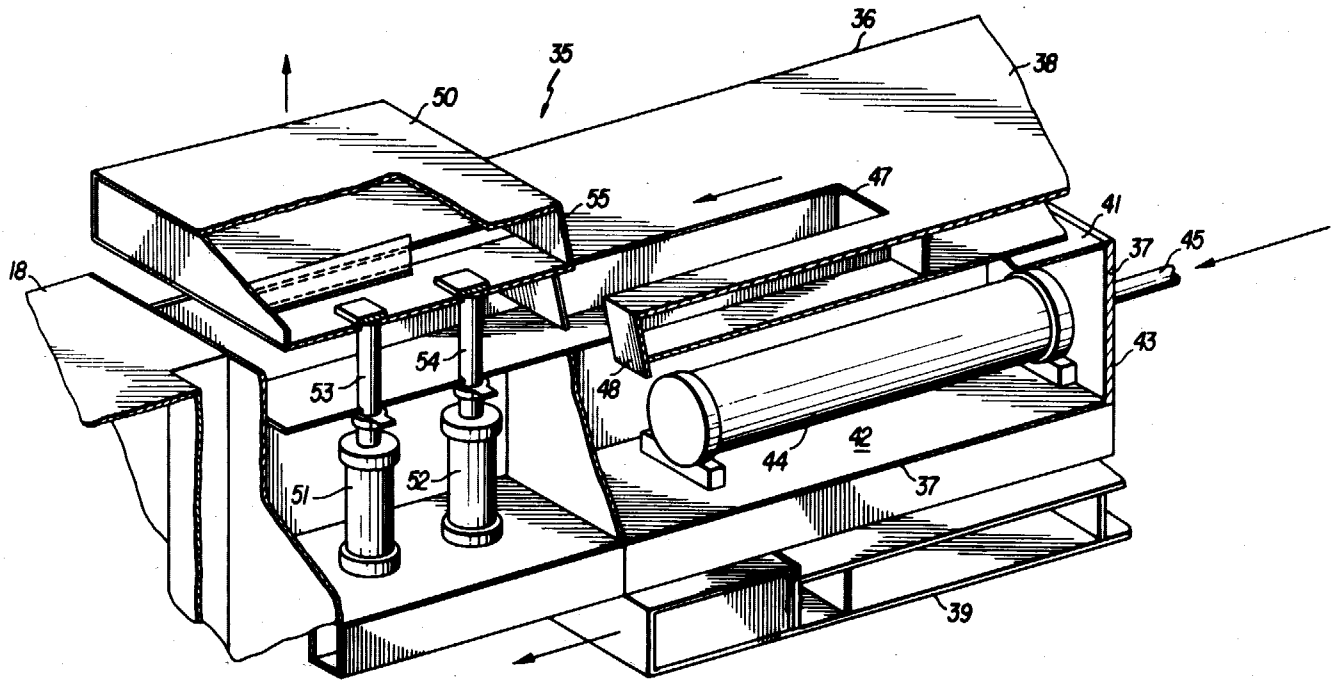
FIG. 3 is an enlarged fragmentary perspective view of the telescoping section of the portable lifting beam main beam, portions thereof being cut away for clarity to illustrate the breech block or compression wedge and its associated hydraulic lifting mechanism, as well as the hydraulic mechanism for extending and retracting the telescoping section.
Figure 4:
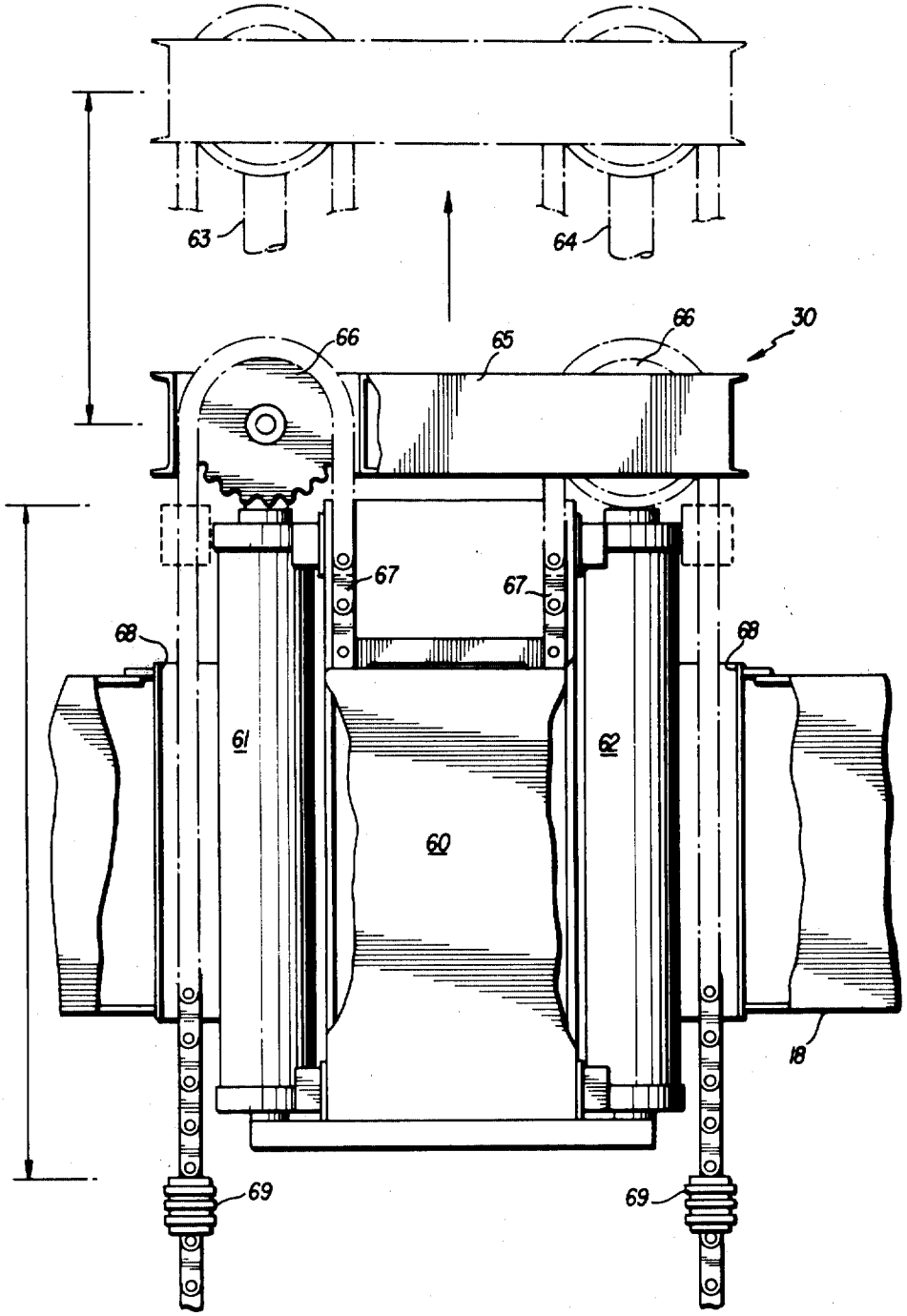
FIG. 4 is an enlarged elevation view of the hydraulic lifting mechanism of the portable lifting beam, portions thereof cut away for clarity, to illustrate the hydraulic cylinders and pistons, and further illustrating the idler sprocket support frame mounted on the piston rods, the frame depicted in phantom in an upper position thereof.

As seen most clearly in FIGS. 2*a* and 3, the telescoping section 35 of the main beam 18 includes an outer housing 36 relatively movable with respect to an inner housing 37. The outer housing 36 includes top and bottom plates 38, 39, and an end plate 40. The inner housing 37 includes top and bottom plates 41, 42 and an end plate 43. A hydraulic cylinder 44 is suitably mounted in the inner housing 37, and includes a piston rod 45 which extends through the end wall 43 and is suitable secured to the end wall 40 of the outer housing 36. The upper plate 38, as seen most clearly in FIG. 3, includes a longitudinally extending slot 47 and a slightly inclined end 48. It should be apparent, in view of the foregoing, that actuation of the hydraulic cylinder 44, by means of hydraulic fluid supplied through the hydraulic system illustrated in FIG. 7, will cause either extension or retraction of the outer housing 36 with respect to the inner housing 37.

The telescoping section 35 further includes a breech block 50 which may be raised above or lowered into the plane of the top plate 38 of the outer housing 36 by means of hydraulic cylinder 51, 52 and their respective piston rods 53, 54. The breech block includes an inclined end plate 55 adapted to mate with the end plate 48 when the breech block 50 is lowered into the plane of the top plate 38 as seen in FIG. 2*a*. As should be apparent, the breech block 50 provides rigid insert into the main beam 18 when the telescoping section 35 is extended to its maximum extent. When the telescoping sections 35 is retracted inwardly to its maximum extent, the breech block 50 will be in its uppermost position as seen in FIG. 3, with the longitudinally extending slot 47 of the top plate 38 receiving the piston rods 53, 54 of the hydraulic cylinder 51, 52.

The hoisting or lift assembly 30, as seen in FIGS. 1, 2*a* and *b*, and 4, includes a main housing 60 carried centrally of the main beam 18. The housing 60 supports two hydraulic cylinder 61, 62 from which piston rods 63, 64 extend upwardly, respectively. The piston rods 63, 64 carry a support frame 65 in which four idler sprocket wheels 66 are suitably journaled. The lifting assembly 30 further includes four hoisting chains 67 each of which is secured at one end to the housing 60 and disposed over a respective sprocket wheel 66. The free ends of each of the chains 67 extend downwardly from its respective sprocket wheel 66 through suitable vertically extending openings 68 in the main beam 18. Each of the chains 68 carries a suitable isolation block 69 for providing electrical and thermal insulation between the lower parts of the chains 67 and the remainder of the hoisting arrangement. Each of the isolation blocks 69 includes a plurality of thermal and electrical insulation layers whereby the heat and any electrical charge carried by a spent pot shell connected to the hooks 70 of the chains 67 will be prevented from being transmitted through the chains 67 to the hoisting assembly 30 and thereby the remainder of the tandem crane apparatus. The insulation layers may be formed of asbestos or other like suitable insulation material.

As should be apparent, in operation of the hoisting or lifting assembly 30, by appropriate control of the supply of a hydraulic fluid to the cylinder 61, 62 from the hydraulic control system illustrated in FIG. 5, the frame 65 supported on the piston rods 63, 64 will be either raised or lowered, thereby effecting both translation and rotation of the idler sprocket wheels 66. This combined translation and rotation results in a 2:1 ratio of movement of the chains 67 with respect to the movement of the frame 65. As illustrated in FIG. 1, the free ends of the hoisting chains 67 carry loadengaging means or hooks 70 which are adapted to be connected to the load.

Figure 2B:
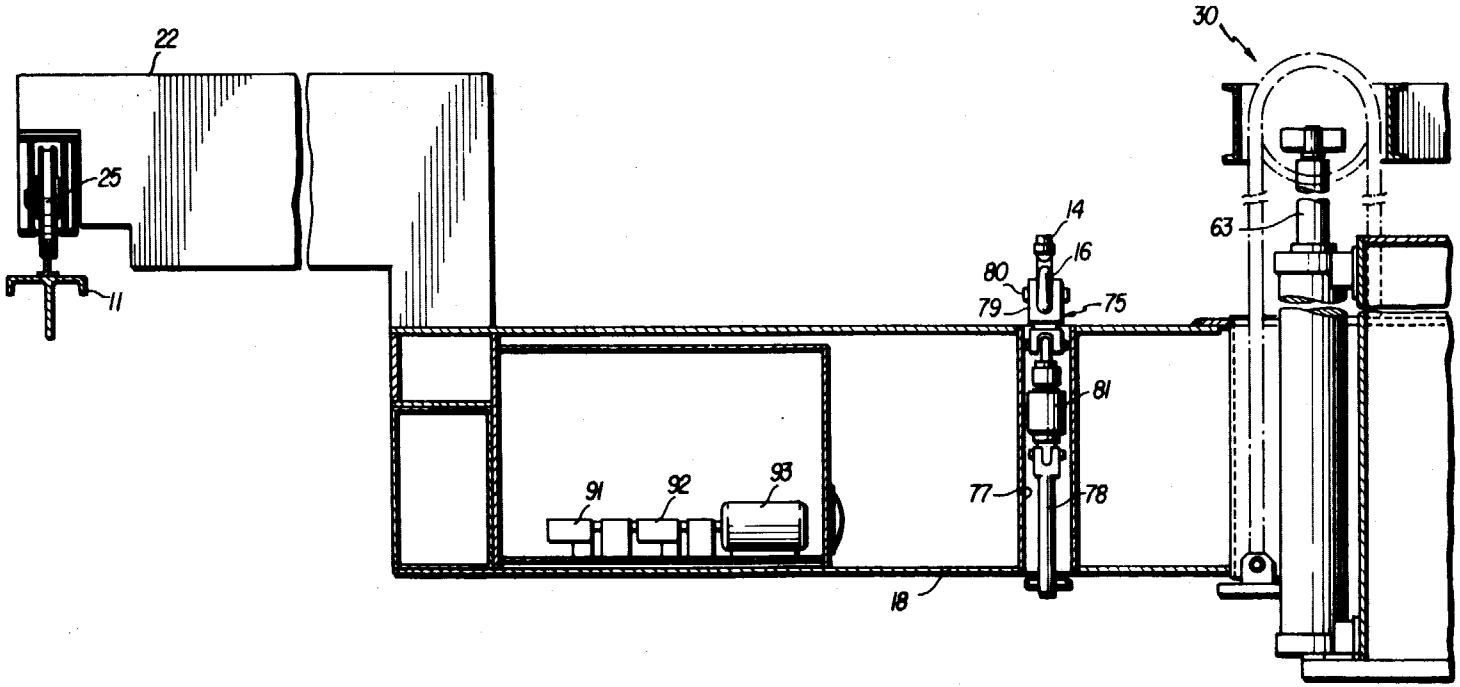

As seen in FIGS. 2*a* and 2*b*, the main beam 18 of the portable lifting beam 10 includes coupling assemblies 75, 76 disposed on opposite sides of the hoisting assembly 30. The coupling assemblies 75, 76 are mounted in vertically extending openings 77 provided in the main beam 18. The coupling assemblies 75, 76 include mounting rods 78 suitably secured in the openings 77 and a block 79 in which a pin 80 is mounted for receiving the hooks 16, 17 of the hoist cables 14, 15 of the bridge crane 13. Disposed between the mounting rods 78 and the blocks 79 are load cells 81 which are adapted to measure and indicate the amount of load carried by the bridge crane 13. The manner in which the load cells 81 are utilized in the operation of the tandem crane arrangement will be explained more fully hereinafter.

Turning now to FIG. 5, there is diagrammatically illustrated details of the hydraulic control system of this invention. The hydraulic system includes a reservoir 90 from which hydraulic fluid may be pumped by means of pumps 91, 92 driven by an electric motor 93. The pumps 91, 92 and the motor 93 are housed in the interior of the main beam 18 as seen in FIG. 2*b*. Hydraulic lines 94, 95 extend from each of the pumps 91, 92, respectively, through suitable check valves to the various hydraulic control cylinders associated with this invention. Thus, it can be seen from FIG. 5 that the hydraulic lines 94, 95 extend to the cylinder 61, 62 of the hoisting assembly 30, the cylinders 51, 52 of the breech block 50, the cylinder 44 of the telescoping section 35, and to at least one locking pin assembly 96 which is actuated when the hoisting assembly 30 reaches its maximum vertical extent whereby the load may be securely fastened to the main beam 18 of the portable lifting beam 10. The hydraulic control system further includes appropriate four-way valves 97, 98, 99 and 100 associated with each of the hydraulic cylinders for controlling the operation thereof. Additionally, suitable check valves are provided in communication with the piston side of each of the cylinders for providing a positive stop in the event that one of the hydraulic lines fails.

Referring now to FIGS. 6*a*, *b* and *c* there is illustrated the sequence of operating steps in the positioning of the portable lifting beam 10 on the rails 11, 12 by means of the bridge crane 13. The first step, of course, is for the portable lifting beam 10 to be transported by means of a suitable ground vehicle, such as an appropriate trailer, to the appropriate potline and positioned beneath the existing bridge crane 13. Thereupon the hoist cables 14, 15 of the bridge crane 13 are lowered and the hooks 16, 17 are connected to the appropriate coupling assembly 75, 76, as seen in FIG. 6*a*. In this position the main beam 18 of the portable lifting beam 10 is in its retracted position.

The hoist motor (not shown) of the bridge crane 13 is then activated to lift the portable lifting beam 10 until its wheels 25 are disposed above the plane of the side rails 11, 12, as seen in FIG. 6*b*. At this point the overhead carriage (not shown) of the bridge crane 13 is trolleyed to the left, as seen in FIG. 6*b*, so that the wheels 25 on the fixed side of the main beam 18 are disposed directly above the rail 11. Hydraulic fluid is then admitted into the piston side of the hydraulic cylinder 44 to extend the telescoping section 35 of the main beam 18 until the wheels 25 carried at the telescoping end 35 are disposed directly above the rail 12. At this point the hydraulic cylinders 51, 52 are actuated to lower the breech block 50 to the position illustrated in FIG. 2*a*, thereby establishing a rigid connection with the top plate 38 of the outer housing 36. The hoist cables 14, 15 are then lowered slightly until the wheels 25 of the portable lifting beam 10 engage the rails 11, 12. This is illustrated in FIG. 6*c*.

With the lifting beam 10 and crane 13 thus locked together, the crane operator will then move them in tandem through the pot room and spot them in operative position over a spent pot shell. In traversing the lifting beam 10 and crane 13 along the rails 11, 12, drive power is supplied independently to each of the respective drive wheels. However, the system is preferably designed such that power to the drive wheels 25 is cut off by means of speed switch interlocks when the lifting beam 10 is moving at 30 feet per minute. Above this rate of speed, the tandem unit can be driven solely by the drive of the bridge crane 13. The portable lifting beam 10 perferably includes brakes (not shown) which will be automatically released when power is supplied to the bridge crane drive.

When the tandem crane arrangement is in position over a spent pot shell, the hoisting chains 67 are lowered and the hooks 70 coupled to the shell. At this point the hoist motor (not shown) of the bridge crane 13 is energized and the load cells are monitored to determine when the bridge crane 13 is carrying a predetermined portion of the load, preferably 40 tons when lifting a 95 ton pot shell. At this point the hoist motor of the bridge crane 13 is stopped and the hoisting assembly 30 of the lifting beam 10 activated so that the portable lifting beam 10 will carry the remainder of the load. When the load is lifted to its maximum extent and in position directly beneath the main beam 18, the locking pins 96 (FIG. 5) will be actuated to lock the shell securely against the main beam 18. The spent shell may then be transported along the potline to a position over a trailer whereupon the foregoing steps may be reversed and the shell lowered onto the trailer whereby it may be transported to a maintenance station.

A relined spare shell may then be transported to the potline and installed in place by means of the tandem crane arrangement following the opposite sequence of operations enumerated above.

The portable lifting beam 10 may then be lowered and disengaged from the existing bridge crane, and transported back to its storage area. The existing bridge crane 13 is then free to perform routine functions in the potline until such time as it is necessary to recouple it with the portable crane 10 for lifting another spent shell.

In view of the foregoing, it should be apparent that there is provided in accordance with this invention a novel portable lifting beam or Strongback that may be used in conjunction with an existing overhead bridge crane to facilitate improved operating efficiency and production in aluminum reduction plants. The novel tandem arrangement of crane facilitates removal of a spent pot shell without first removing the bath-absorbed lining therefrom, and replacement of a relined shell, thereby dramatically reducing the downtime of an electrolytic cell in an aluminum reduction plant by approximately 85% as compared with prior art methods.

Although only a preferred embodiment of the invention has been specifically illustrated and described herein, it is to be understood that minor modifications could be made therein without departing from the spirit of the invention.

It is claimed:

1. A portable lifting beam for being transported to a worksite and lifted by an existing bridge crane to an operative position spanning two parallel rails, said portable lifting beam that support a movable lifting means and including a horizontally extending main beam having means at the ends thereof carrying wheels for rollingly supporting said portable lifting beam on said rails, said main beam including a telescoping section, means for controllably retracting said telescoping section to reduce the longitudinal extent of said main beam to a dimension less than the distance between said parallel rails whereby said portable lifting beam may be raised and lowered between said rails while being disposed perpendicular thereto, means for controllably extending said telescoping section from its retracted position to increase the longitudinal extent of said main beam to a dimension equivalent to the distance between said parallel rails for positioning said wheels thereon, and means for locking said telescoping section in its fully extended position.

2. A portable lifting beam as defined in claim 1, wherein said locking means includes a breech block movable into said beam for establishing a rigid connection when said telescoping section is fully extended.

3. A portable lifting beam as defined in claim 2, said breech block being supported on hydraulic means for raising or lowering said breech block, said hydraulic means being mounted internally of said main beam.

4. A portable lifting beam as defined in claim 1, wherein said means for retracting and said means for extending include hydraulic means mounted internally of said telescoping section and extending longitudinally thereof, said telescoping section including inner and outer relatively movable concentric housings, said hydraulic means including a cylinder mounted within said inner housing and having an operating arm rigidly connected to said outer housing, whereby actuation of said hydraulic means will cause said operating arm to move said outer housing thereby effecting either retraction or extension of said telescoping section.

5. A portable lifting beam as defined in claim 1, including hydraulic lifting means carried by said main beam, said lifting means including at least one vertically disposed cylinder and piston arrangement, an operating rod extending from said piston, an idler sprocket support frame carried by said operating rod, at least one idler sprocket wheel rotatably mounted in said support frame, a hoisting chain disposed over said at least one sprocket wheel, one end of said chain being connected to said main beam and the other end carrying load-engaging means adapted to be connected to a load, and a source of hydraulic fluid to be selectively supplied to said hydraulic lifting means, whereby raising or lowering of said operating rod will cause translation and rotation of said at least one idler sprocket wheel and movement of said chain to move a load in the corresponding direction.

6. A portable lifting beam as defined in claim 5, wherein said lifting means includes two cylinder and piston arrangements, each of which includes an operating rod connected to said support frame, four idler sprocket wheels rotatably mounted in said support frame, and a hoisting chain disposed over each of said four sprocket wheels.

7. A portable lifting beam as defined in claim 6, further including electrical insulator means in each of said chains.

8. A method of operatively positioning a longitudinally extensible portable lifting beam in overhead relation to a load, comprising the steps of:

a. disposing the portable lifting beam beneath an overhead bridge crane carried by overhead parallel rails with the portable lifting beam aligned transverse to the rails and longitudinally extending a distance less than the distance between said rails;

b. lifting the portable lifting beam with the bridge crane to a position above the rails;

c. extending the portable lifting beam longitudinally to position the extremities thereof over the rails;

d. locking said portable lifting beam in an extended position;

e. lowering the portable lifting beam onto the rails such that it is supported both by the rails and by the bridge crane; and f. moving both the bridge crane and the portable lifting beam as a unit along the rails to a position above a load.

9. A method as defined in claim 8, wherein said step of extending includes trolleying the portable lifting beam toward one of said rails and supporting one end thereof on said rail, and thereafter telescopically expanding the other end of the portable lifting beam until it reaches a position over the other rail.

* * * * *